US005820488A

United States Patent [19]

Sullivan et al.

[11] Patent Number: 5,820,488

[45] Date of Patent: Oct. 13, 1998

[54] GOLF BALL AND METHOD OF MAKING SAME

[76] Inventors: Michael J. Sullivan, 58 Marlborough St.; Thomas J. Kennedy, 27 Allen St., both of Chicopee, Mass. 01020; Mark Binette, 241 Elizabeth Dr., Ludlow, Mass. 01056

[21] Appl. No.: 873,820

[22] Filed: Jun. 12, 1997

Related U.S. Application Data

[63] Continuation of Ser. No. 396,245, Feb. 28, 1995, abandoned, which is a continuation of Ser. No. 98,981, Jul. 29, 1993, abandoned.

[51] Int. Cl.[6] ..... A63B 37/06; A63B 37/12; A63B 37/14

[52] U.S. Cl. ..... 473/374; 473/377; 473/378

[58] Field of Search ..... 473/361, 362, 473/363, 364, 365, 373, 374, 376, 378

[56] References Cited

U.S. PATENT DOCUMENTS

| | | | |
|---|---|---|---|
| 2,730,159 | 1/1956 | Semegen | 154/17 |
| 2,741,480 | 4/1956 | Smith | 273/227 |
| 2,973,800 | 3/1961 | Muccino | 154/17 |
| 3,053,539 | 9/1962 | Piechowski | 273/230 |
| 3,989,568 | 11/1976 | Isaac | 156/182 |
| 4,272,079 | 6/1981 | Nakada et al. | 273/225 |
| 4,483,537 | 11/1984 | Hanada et al. | 273/220 |
| 4,561,657 | 12/1985 | Tominaga et al. | 273/218 |
| 4,679,794 | 7/1987 | Yamada et al. | 273/235 |
| 4,858,924 | 8/1989 | Saito et al. | 273/62 |
| 4,919,434 | 4/1990 | Saito | 273/235 |
| 4,955,966 | 9/1990 | Yuki et al. | 273/218 |
| 4,998,734 | 3/1991 | Meyer | 273/235 |
| 5,029,870 | 7/1991 | Concepcion et al. | 273/235 |
| 5,072,944 | 12/1991 | Nakahara et al. | 273/220 |
| 5,187,013 | 2/1993 | Sullivan | 428/407 |
| 5,439,227 | 8/1995 | Egashira et al. | 473/374 |

FOREIGN PATENT DOCUMENTS

| | | | |
|---|---|---|---|
| 4-109970 | 4/1992 | Japan . | |
| 494031 | 10/1938 | United Kingdom | 273/225 |
| 2 245 580 | 1/1992 | United Kingdom . | |
| 2 248 067 | 3/1992 | United Kingdom . | |

OTHER PUBLICATIONS

"Ionomer", Robert J. Statz, Ph.D., Modern Plastics Mid–October Encyclopedia Issue, p. 86, 1989.
WPI abstract for JP 4277533 Oct. 2, 1992.
WPI abstract for JP 2159285 Jun. 19, 1990.
WPI abstract for JP 58165871 Sep. 30, 1983.
WPI abstract for JP 89055029 Nov. 22, 1989.
WPI abstract for JP 58113269 Jul. 6, 1983.
WPI abstract for US 4,085,937 Apr. 25, 1978.

*Primary Examiner*—George J. Marlo

[57] ABSTRACT

A non-wound golf ball, comprising a central core, a cover having a thickness of at least about 30 mils and comprising a member selected from the group consisting of ionomers, acrylic acid, methacrylic acid and polyethylene surrounding the core, and a moisture barrier surrounding the core and being located between the cover and the core. The moisture barrier has a lower water vapor transmission rate than the cover and an average thickness substantially less than the cover thickness. The moisture barrier has a water vapor transmission rate which is sufficiently low to reduce the loss of coefficient of restitution of the golf ball by at least 5% if the ball is stored at 100° F. and 70% relative humidity for six weeks as compared to the loss in coefficient of restitution of a golf ball which does not include the moisture barrier, has the same type of core and cover, and is stored under substantially identical conditions.

20 Claims, 1 Drawing Sheet

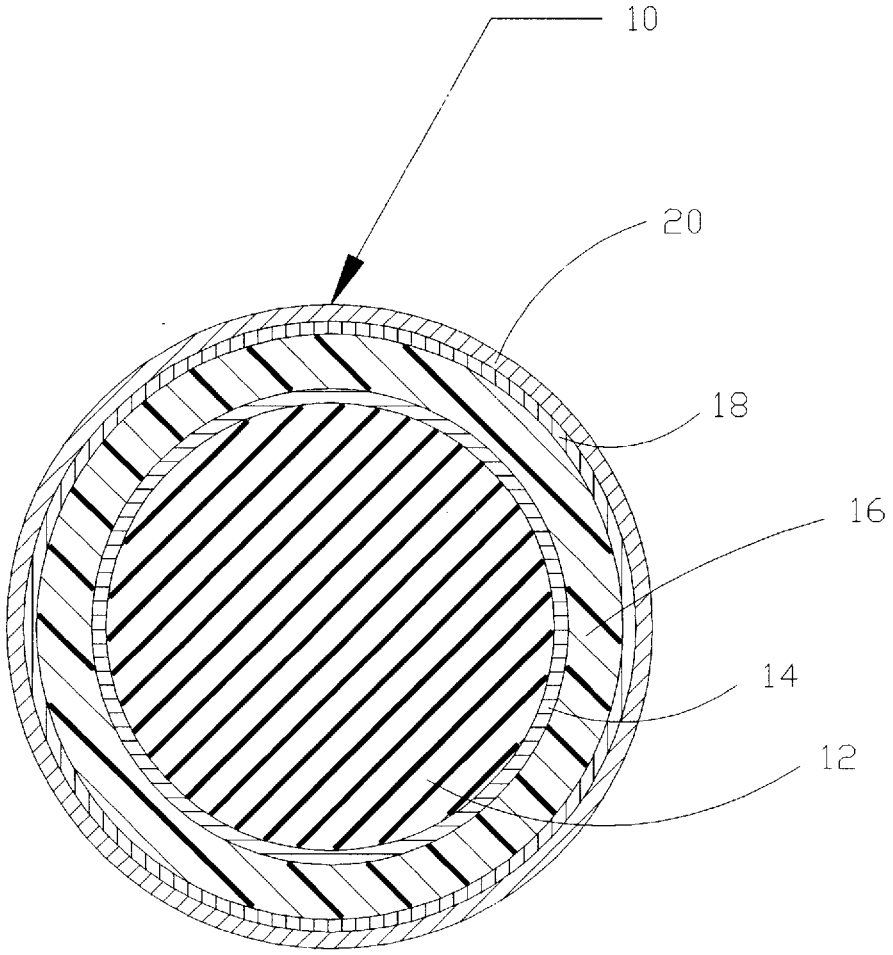
10
20
18
16
14
12

GOLF BALL AND METHOD OF MAKING SAME

This application is a continuation of application Ser. No. 08/396,245 filed on Feb. 28, 1995, now abandoned which is a continuation of application Ser. No. 08/098,981 filed on Jul. 29, 1993, now abandoned.

FIELD OF THE INVENTION

The present invention relates to golf balls, and more particularly relates to golf balls having an increased shelf life.

BACKGROUND OF THE INVENTION

The distance a golf ball will travel when hit by a golf club is a function of many factors, including angle of trajectory, clubhead speed and coefficient of restitution. The coefficient of restitution ("COR") is a measurement familiar to those skilled in the golf ball art. One way to measure the COR is to propel a ball at a given speed against a hard massive surface and measure its incoming and outgoing velocity. The COR is the ratio of the outgoing velocity to the incoming velocity and is expressed as a decimal between zero and one.

There is no United States Golf Association limit on the COR of a golf ball, but the initial velocity of the golf ball cannot exceed 250+−5 feet/second. As a result, the industry goal for initial velocity is 255 feet/second, and the industry strives to maximize the COR without violating this limit.

In a one-piece solid golf ball, the COR will depend on a variety of characteristics of the ball, including its composition and hardness. For a given composition, COR will generally increase as hardness is increased. In a two-piece solid golf ball, which includes a core and a cover, one of the purposes of the cover is to produce a gain in COR over that of the core. When the contribution of the core to high COR is substantial, a lesser contribution is required from the cover. Similarly, when the cover contributes substantially to high COR of the ball, a lesser contribution is needed from the core.

Conventional one-piece golf balls and cores for two-piece golf balls comprise an elastomer, such as a high cis content polybutadiene, which is combined with a zinc or other metal salt of an $\alpha,\beta$, ethylenically unsaturated carboxylic acid such as acrylic acid, methacrylic acid, crotonic acid, or cinnamic acid, etc. To achieve higher COR, small amounts of a metal oxide such as zinc oxide can be added. In addition, larger amounts of zinc oxide than are needed to achieve the desired coefficient can be included in order to increase the core weight so that the finished ball more closely approaches the U.S.G.A. upper weight limit of 1.620 ounces. Other materials also can be used in the core composition including compatible rubbers or ionomers, and low molecular weight fatty acids such as stearic acid. Free radical initiator catalysts such as peroxides are added to the core composition so that on application of heat and pressure, a complex curing or cross-linking reaction takes place. Golf ball core compositions are discussed in further detail in U.S. Pat. No. 5,018,740, the contents of which are incorporated herein by reference.

The covers of solid two-piece golf balls are typically made from a material which will contribute to the durability of the ball. Furthermore, as mentioned above, the use of a cover enables a higher COR to be achieved for golf balls having a specific hardness. In addition, inclusion of a cover will facilitate processing of the golf balls.

The covers of two-piece solid golf balls are generally formed from durable ionomeric resins such as those manufactured by E. I. DuPont de Nemours & Company under the trademark "Surlyn$^R$", and by Exxon Corporation under the trademarks "Escor$^R$" and "Iotek$^R$". Ionomeric resins are generally ionic copolymers of an olef in such as ethylene and a metal salt of an unsaturated carboxylic acid, such as acrylic acid, methacrylic acid, or maleic acid. Metal ions, such as sodium or zinc, are used to neutralize some portion of the acidic groups in the copolymer resulting in a thermoplastic elastomer exhibiting enhanced properties, i.e., durability, etc. for golf ball cover construction.

Ionomeric golf balls covers frequently contain a fluorescent material and/or a dye or pigment which imparts to the outer surface of the ball the desired color characteristics. Trademarks or other indicia are stamped on the outer surface of the ball cover, which is then coated with one or more thin layers of a clear coat material. The clear coat gives the ball a glossy finish and protects the indicia stamped on the cover. Clear coat materials which are well known in the art, typically include epoxies and urethanes.

SUMMARY OF THE INVENTION

It has now been found that when solid and wound golf balls are subjected to prolonged storage under ambient conditions, the CORs of the golf balls tend to decrease over time. As the CORs of the balls decrease, their weight increases. The reduction in COR and the weight gain is believed to be due to the absorption of moisture within the balls. It has been found that moisture is not only absorbed and retained by golf balls soaked in water, but also by golf balls which are stored under conditions in which moisture is in the air, including indoor and outdoor conditions of "average" humidity, i.e. 25–35% relative humidity (RH), as well as conditions of high humidity, i.e. 65–75% RH, or more. The degree of COR loss within a specified period of time has been found to be higher for golf balls which are stored in a highly humid environment than for golf balls which are stored in an environment of lower humidity. COR loss is greater for golf balls which are soaked in warm water than for golf balls which are soaked in cooler water. The present invention overcomes the COR loss problem described above by surrounding the core of a golf ball with a moisture barrier which has a lower water vapor transmission rate that the cover of the ball. The moisture barrier most preferably is positioned between the cover and the core, but also can be positioned between the cover and clear coat. Although the barrier theoretically can be positioned outside the clear coat in certain cases, this is less desirable since it may subject the layer to damage during use. Preferably, the moisture barrier is a layer having a thickness on the order of between molecular thickness and 20 mils and is used in conjunction with a cover which has a thickness of at least about 25–30 mils, and preferably is on the order of 50–100 mils.

Another preferred form of the invention is a golf ball core for use in making a solid or wound golf ball having a cover. The core includes an outer moisture barrier which has an average thickness of no more than about 20 mils and exhibits a lower water vapor transmission rate than the cover.

In another preferred form, the invention is a golf ball comprising a central core, a cover, and a moisture barrier surrounding the core, the moisture barrier being effective to reduce the loss in coefficient of restitution of the golf ball after storage for six weeks at about 100° F. and about 70% relative humidity by at least 5%, preferably by at least 10–15%.

In yet another preferred form, the invention is directed to a golf ball core for use in making a one, two or multi-piece golf ball. The core has an interior core portion having an outer surface and a moisture barrier in intimate engagement with the outer surface having an average thickness of no more than about 20 mils and a water vapor transmission rate of about 0.2 g·mil/100 in$^2$·day at 90% RH, 100° F., ASTM D-96 or less. More preferably, the moisture barrier has an average thickness of about 10 mils or less and a water vapor transmission rate of about 0.05 g·mil/100 in$^2$·day at 90% RH, 100° F., ASTM D-96 or less. Most preferably, the water vapor transmission rate of the barrier is 0.03 g·mil/100 in$^2$·day at 90% RH, 100° F., ASTM D-96 or less.

The moisture barrier layer according to the invention preferably is a continuous layer surrounding the entire core. The layer can be formed of any moisture barrier material which, at the thickness used, does not significantly affect the favorable playability characteristics of the golf ball, and provides for a reduction in the rate of entry of water and/or water vapor into the golf ball core, preferably to a degree sufficient to reduce COR loss of the ball by at least about 5% for a golf ball stored at 100° F. and about 70% RH. In one referred form of the invention, the moisture barrier layer is formed from a different material than the core, and comprises or consists of at least one member of the group consisting of vinylidene chloride, which preferably is in the form of polyvinylidene chloride, vermiculite, i.e. a mica-like material which is a hydrated-magnesium-aluminum silicate formed by the geochemical alteration of biotite. Other types of barrier materials which form separate layers also can be used. In another preferred form, the moisture barrier layer is formed in situ as the reaction product of a barrier-forming material and the outer surface of the core. For example, fluorination of the outer surface of the core has been found to form a useful barrier layer on the outer surface to reduce COR loss over time. It is expected that other gaseous barrier-forming substances known to those skilled in the art also can be reacted with the outer surface of the core material to act as a barrier layer or film.

When applied between the core and cover of a two-piece golf ball, the barrier layer has a lower water vapor transmission rate than the cover. Preferably, this rate is very low, i.e. less than about 0.2 g·mil/100 in$^2$·day at 90% RH, 100° F., ASTM D-96, and more preferably less than about 0.05 g·mil/100 in$^2$·day at 90% RH, 100° F., ASTM D-96. The moisture barrier layer is particularly well suited for use with a two-piece solid golf ball having a polybutadiene composition core and an ionomer cover.

Yet another preferred form of the invention is a method for reducing the loss in coefficient of restitution of a golf ball upon exposure to moisture. The method includes the provision for a moisture barrier layer around the golf ball core. In a two-piece or multi-piece golf ball, the moisture barrier layer as a lower permeability of water than the cover. In a one-piece golf ball or another preferred two-piece or multi-piece ball, the moisture barrier layer has a thickness of no more than about 20 mils and preferably has a water vapor transmission of no more than about 0.2–0.3 g·mil/100 in$^2$·day at 90% RH, 100° F., ASTM D-96. Along these same lines, the invention includes a method for making a golf ball having a core, the method comprising the step of forming a moisture barrier around the core, the moisture barrier being effective to reduce the loss in coefficient of restitution of the golf ball after storage for six weeks at about 100° F. and about 70% relative humidity by at least 5%.

An object of the present invention is to provide a golf ball having a longer shelf life than conventional golf balls.

Another object of the invention is to provide a one, two, or multi-piece golf ball in which the loss in COR due to moisture is substantially reduced.

Yet another object of the invention is to provide a golf ball which substantially retains its original COR upon exposure to a wide range of temperatures and humidity levels.

Yet another object of the invention is to provide a method of making a golf ball having the advantages described above.

Other objects would be in part obvious and in part pointed out more in detail hereinafter.

The invention accordingly comprises the article possessing the features, properties and the relation of elements exemplified in the following detailed disclosure, and the several steps and the relation of one or more of such steps with respect to each of the others as described below.

BRIEF DESCRIPTION OF THE DRAWING

The FIGURE schematically shows a golf ball according to the invention.

DETAILED DESCRIPTION OF THE INVENTION

The present invention recognizes the problem that conventional golf balls which are stored for an extended period of time can undergo a reduction in COR due to the gradual permeation of liquid water and/or water vapor into the core. The invention overcomes this newly-recognized problem by providing a moisture barrier around the golf ball core for substantially preventing, or at least reducing, the entry of water vapor and liquid water into the core.

The invention is particularly applicable to a two-piece solid golf ball such as a ball having an overall diameter of 1.680 inches or more which includes a cover which is about 30–110 mils thick. As is shown in the FIGURE, this type of ball, which is designated as 10, includes a solid central core 12, a thin moisture barrier layer 14 surrounding the core, and a cover 16 surrounding the moisture barrier layer. A thin primer coat 18 is positioned over the golf ball cover 16, and a thin, shiny top coat 20 provides the outer surface finish of the ball. The thickness of the moisture barrier layer 14 as well as the thicknesses of the primer 18 and the top coat 20 have been exaggerated in the FIGURE for ease of understanding. In two-piece solid golf balls, the moisture barrier preferably is a moisture-impermeable membrane which is positioned between the central core and the cover as is shown in the FIGURE. When placed at this location, it is likely that minimal design and manufacturing changes will be required for manufacturing the golf ball, because the moisture barrier is protected by a durable ionomeric or balata cover. Furthermore, because the moisture barrier is sandwiched tightly between the core and the cover, the strength of the physical or chemical bonds holding the moisture barrier in place need not be as strong as the bonding which would be required if the moisture barrier were positioned on the outer surface of the golf ball. It is noted, however, that it is also possible to locate a non-brittle moisture barrier of a two-piece ball between the cover and primer or between the primer and clear coat, as long as the moisture barrier is sufficiently durable that the ball has acceptable playability and wear characteristics. In a one-piece ball, the moisture barrier generally is located on the outer surface of the core.

The moisture barrier should be sufficiently thick to result in a reduction in the permeability of liquid water and water vapor into the core of a golf ball, while being thin enough to avoid having an adverse impact on the playability of the ball. As a practical matter, it is desirable to select a barrier material which has very low water permeability in order that only a thin layer of the barrier is required. As used herein, the term "water permeability" refers to the ability of liquid water and/or water vapor to permeate through a layer such as a coating on a golf ball into the golf ball core.

Generally, a polyvinylidene chloride moisture barrier positioned between the core and cover of a two-piece ball and which has a thickness of ½–20 mils (depending on the effectiveness of the barrier) will reduce COR loss. Preferably, the polyvinylidene chloride moisture barrier is less than half the thickness of the cover. Some non-limiting examples of commercially available polyvinylidene chloride moisture barriers (Dow Chemical Co.) which can be used in accordance with the invention include:

| Barrier | water vapor transmission rate (g · mil/100 in$^2$ · day at 90% RH 100° F., ASTM D-96) |
|---|---|
| Saran ® Resin F-279 | 0.02 |
| Saran ® Resin F-239 | 0.03 |
| Saran ® MA 119 | 0.05 |
| Saran ® 525 | 0.13 |
| Saran Wrap ™ Films | 0.20 |

It is expected that Saran barriers with a thickness of ½–20 mils placed directly over the core will not otherwise substantially affect the playability of the ball. Typically the barrier layer has a thickness of 5–15 mils. Also, it has been found that the polyvinylidene chloride layer can be covered by a film of metallized polyester, such as aluminized polyester, to form a moisture barrier. If the barrier is to be placed outside the cover, it should be sufficiently thin to avoid interfering with the effectiveness of the dimples.

Vermiculite barriers, preferably of about 1–15 mils, more preferably 5–10 mils, also will reduce the initial rate of COR loss when placed between the core and cover.

While the thickness of a moisture barrier formed in situ, such as by fluorinating a golf ball core, cannot be conveniently measured, it is expected that such barriers may be of molecular layer thickness and certainly are thinner than most, if not all, of the film-forming barrier layers applied as coatings, such as polyvinylidene chloride and vermiculite. It is expected that fluorination of the outer surface of a golf ball cover also will form a moisture barrier layer.

The moisture barrier of the invention also can be adapted for use with conventional one-piece golf balls, such as those having an overall diameter of 1.680 inches or more. As mentioned above, this type of moisture barrier is located between the core and the primer or between the primer and clear-coat.

The moisture barrier layer of the invention is useful to protect cores containing polybutadiene and metal salts of unsaturated carboxylic acids such as acrylic, methacrylic, crotonic and cinnamic acids, etc. It is expected that the moisture barrier also can be used in conjunction with cores made of other materials, including two-piece cores such as those described in U.S. Pat. No. 5,072,944, and in conjunction with wound cores.

The cover material of a two-piece golf ball generally has a lower water vapor transmission rate than the core material. Ionomers which are copolymers of ethylene and a metal salt of an unsaturated carboxylic acid have been preferred for use as golf ball cover material due to their high durability, contribution to good COR and compressibility. These ionomers have been found by the inventors to be better barriers to water vapor transmission than many other thermoplastics. Such covers have, in the past, been about 40–100 mils thick. While for two piece balls, ionomeric covers are preferred for use in conjunction with the moisture barriers of the invention, the invention also encompasses golf balls having covers made of other materials, several non-limiting examples of which include nylons, thermoplastic urethanes, polyurethane, acrylic acid, methacrylic acid, thermoplastic rubber polymers consisting of block copolymers in which the elastomeric midblock of the molecular is an unsaturated rubber or a saturated olefin rubber, e.g. Kraton$^R$ rubbers (Shell Chemical Co.), polyethylene, and synthetic or natural vulcanized rubber such as balata.

In order to be effective, the moisture barrier should have a lower water vapor transmission rate than the other layers which are between the core and the outer surface of the ball, i.e. the cover, primer (if included) and clear coat. As used herein, "water vapor transmission rate" refers to the rate as expressed in units of g·mil/100 in$^2$·day at 90% RH, 100° F., ASTM D-96. The water vapor transmission rate of the moisture barrier preferably is significantly less than 1.5 g·mil/100 in$^2$·day at 90% RH, 100° F., ASTM D-96.

The effectiveness of a moisture barrier will depend upon the composition of the barrier and its thickness. From a practical standpoint, it is preferred that the moisture barrier is effective to reduce the loss in coefficient of the golf ball after storage for six weeks at about 100° F. and about 70% RH by at least 5%, and more preferably by at least 10%–15%, as compared to the loss in coefficient of restitution of a golf ball which does not include the moisture barrier, has the same type of core and cover (if included), and is stored under substantially identical conditions. It is noted that barriers which produce a reduction in COR loss of 0.5 to 5% are also within the scope of this invention. If a thick moisture barrier is placed over the core or cover, it is necessary to reduce the cover thickness by an amount equal to the thickness of the barrier in order that the golf ball which has improved moisture resistance is identical in size to a corresponding ball which does not include a moisture barrier. Although the moisture barrier preferably is not an ionomer, it is within the scope of the invention to form a cover having several layers of different ionomeric materials, one of which has a considerably lower water vapor transmission rate than the others and therefore serves as a moisture barrier.

It has been found that a variety of different types of materials will serve as moisture barriers to reduce COR loss when used to form a layer surrounding the core of a two-piece ball. These materials include polyvinylidene chloride, vermiculite and the reaction product of the thermoplastic core material, e.g. polybutadiene and/or other core components, with fluorine gas. It is expected that any film-forming material having a water vapor transmission rate which is less than the water vapor transmission rate of the cover material can be used as a moisture barrier for two-piece solid balls. Materials which impregnate the outer layer of the core to form a barrier layer which has a lower water vapor transmission rate than the cover also may be used according to the present invention. The impregnating agent would fill in the pores in the core surface. As mentioned above, barrier materials having water vapor transmission rates as low as 0.02 g·mil/100 in$^2$·day at 90% RH, 100° F., ASTM D-96 are available, such as Saran Resin F-278 (Dow Chemical Co.).

The effect upon the COR and weight of finished golf balls due to prolonged storage under ambient (indoor) conditions (70°–80° F.) and due to prolonged storage in a high humidity oven (100° F., about 70% RH) has been determined for solid two-piece and wound three-piece golf balls sold by various suppliers. The golf balls which were tested had ionomeric or balata covers. Measurements of COR relative to initial COR and weight gain relative to initial weight were made monthly for five months, except that during one month no measurements of weight gain and COR were taken for the balls in the high humidity oven. Each sample contained about six golf balls, and the results were averaged. The results are provided on Tables 1A and 1B. The values of weight gain and COR loss shown on Tables 1A and 1B, as well as on the remaining tables, are cumulative. In this application, oven humidity of "about 70%" constitutes a humidity which is predominately at 69–71% but many experience temporary fluctuations between about 67% and 72%.

As shown on Tables 1A and 1B, the golf balls in the high humidity oven had a greater weight gain and more loss in COR than the same type of golf ball stored under ambient conditions. All of the golf balls kept in the high humidity oven exhibited at least some COR loss. Most of the bails in the high humidity oven experienced a weight gain of at least 0.1 g after 5 months. Most of the golf balls stored under ambient conditions for 5 months experienced a measurable COR loss. While the weight change for most of the balls stored under ambient conditions was too small to be detected, it is believed that minor increases in weight probably occurred.

Changes in the COR and weight of golf balls due to prolonged exposure to various climatic conditions was determined for two-piece solid golf balls and uncovered cores for two-piece solid golf balls. Measurements of weight were taken in milligrams in order to detect small weight changes which were not detectable in the experimental work shown on Table 1A and 1B. The two-piece balls which were used in the tests were unfinished, i.e., did not have a primer or clear coat on the outer surface of the cover. Ball types X and Y had the same type of polybutadiene core and different cover materials. Ball type Z constituted an uncovered core having the same size and composition as the cores of ball types X and Y. The cover materials comprised blends of commercially available ionomers. The changes in COR and weight were measured every two weeks during a 16-week period of exposure to each climatic condition. The results showing changes in COR and weight are provided on Table 2. Each sample contained 6 golf balls, and the results were averaged.

As shown on Table 2, the golf balls which had the greatest reduction in COR are those that were in the high humidity oven at 100° F. and at least 70% RH, and those soaked in water at 75° F. and 100° F. The balls subjected to the latter types of conditions also had the greatest weight gain. It is believed that the weight gain resulted from moisture absorption. As weight gain increased, COR decreased.

A comparison of covered golf balls stored in the high humidity oven and those maintained at room temperature conditions shows that the COR loss of covered balls in the high humidity oven after 2 weeks was generally comparable to the COR loss of balls stored at room temperature for about 16 weeks. The COR loss of uncovered cores stored in the high humidity oven for 2 weeks was generally comparable to the COR loss of uncovered cores stored under ambient conditions for 12–14 weeks.

The results on Table 2 also show that uncovered cores Z had a higher loss in COR and a larger weight gain over time than covered golf balls X and Y subjected to the same conditions. Thus, the cover material has a lower permeability of water and water vapor than the core material. Table 2 also shows that one-piece golf balls, i.e. golf balls which do not have an ionomer cover, would experience an even greater COR loss over time than two-piece balls due to moisture absorption and retention within the core.

The effect on COR loss over time due to the type of cover material which is used for a two-piece solid golf ball was determined for unfinished golf balls which each had the same type of polybutadiene core composition and were covered with a variety of different commercially available cover compositions and blends thereof. Additional cover types which were used include methacrylic acid, acrylic acid and polyethylene. Each of the covers had a thickness of 55 mils. Measurements of weight gain and COR loss were determined after 2, 5, 9, 23 and 42 days. The results are shown on Table 3.

As shown on Table 3, the overall COR loss after 42 days for the ionomer covers ranged from a loss of 0.004 for ionomer 9 to a loss of 0.024 for ionomer 10. With the exception of the polyethylene covered balls, the golf balls balls had a generally consistent correlation between COR loss and weight gain in that a larger weight gain corresponded to a larger COR loss, while a smaller weight gain corresponded to a smaller COR loss.

Having generally described the invention, the following examples are included for purposes of illustration so that the invention may be more readily understood, and are in no way intended to limit the scope of the invention unless otherwise specifically indicated. The cores primarily consist of polybutadiene compositions used in commercially available golf balls. Examples of suitable compositions are discussed in U.S. Pat. No. 4,726,590 and U.S. Pat. No. 5,018,740, the contents of which are incorporated herein by reference. The covers are formed from commercially available ionomers. Examples of suitable cover compositions are discussed in U.S. Pat. Nos. 5,120,791 and 4,884,814, which are incorporated herein by reference.

EXAMPLE 1

Golf Balls having Cores coated with Polyvinylidene Chloride

A first group of polybutadiene golf ball cores, designated as sample 4A, were dipped for about 5 seconds in a solution containing 20 parts polyvinylidene chloride (Saran Resin F-239, Dow Chemical Company), 65 parts tetrahydrofuran (THF) and 35 parts toluene. A second sample of cores designated as sample 4B were dipped for 5 seconds in a solution containing 20 parts polyvinylidene chloride (Saran Resin F-279, Dow Chemical Co.), 65 parts THF and 35 parts toluene. A third group of golf ball cores, designated as sample 4C, were dipped in the same solution as sample 4B, and subsequently, after drying, were wrapped with an aluminized mylar film. The film was stretched to be relatively wrinkle-free and was applied in a thickness such that the total thickness of the polyvinylidene chloride and mylar was about 10 mils. The balls were finished with an epoxy-polyurethane clear coat. The initial average COR and overall film thickness was determined for each of samples 4A–4C, and the average COR was determined for a control sample 4X of 3 uncoated golf ball cores. The cores of samples 4A, 4B, 4C and 4X all had the same composition. The cores of samples 4A–C and 4X were each covered with the same blend of commercially available ionomeric cover materials such that all of the balls had the same outer diameter. All the golf balls and cores were placed in a high humidity oven at 100° F. and 70% RH. Measurements of COR were taken after 2 weeks, 6 weeks, and 10 weeks. The COR values, cumulative COR loss after 2, 6 and 10 weeks, and initial film thicknesses are shown on Table 4.

As shown on Table 4, each of the samples of balls having a moisture barrier experienced a smaller overall COR loss than the balls in control sample 4X. After 6 weeks, the balls in sample 4X, made from uncoated cores, experienced a COR loss of (19/807)·100=2.35%. The balls of samples 4A–4C experienced a COR loss of (14/800)·100=1.75% after six weeks. Thus, the inclusion of a moisture barrier resulted in a (2.35-1.75)·100/2.35=25.5% smaller COR loss after six weeks than the COR loss of golf balls which did not include a moisture barrier. After weeks, the balls of samples 4A, 4B and 4C had undergone 22.0%, 17.6% and 8.1% smaller COR losses, respectively, than the balls of sample 4X.

Film thicknesses ranging from 7 mils to 10 mils all were suitable thicknesses for reducing the amount of COR loss. It is expected, based upon these results, that thinner and thicker layers of polyvinylidene chloride also can be used as moisture barriers.

An additional sample of cores similar to those of sample 4C were further coated with a second coating of polyvinylidene chloride (Saran Resin F-279, Dow Chemical Company) over the layer of metallized polyester. COR measurements, as well as initial film thicknesses were determined. This sample did not result in an improvement in COR loss as compared to the control, and it is believed that the results may have been due to procedural difficulties in applying the barrier layers.

EXAMPLE 2

Golf Balls having Fluorinated Cores

Golf ball cores made of a polybutadiene composition were fluorinated in a 8–10% fluorine-nitrogen atmosphere for 30 minutes at 25° C. Fluorination was conducted by FluoroTec GmbH (Germany) using a proprietary process. Eleven of the fluorinated cores were covered with a cover stock formed from commercially available ionomers containing zinc and sodium and were designated as sample 5A. Twelve cores were covered with the same cover stock at the same thickness for use as a control, and were designated as sample 5X (cover control). Three cores remained uncovered and were designated sample 5Y (core control). The balls remained unfinished.

The initial COR of each golf ball and uncovered core was determined. The initial weight of the balls in each sample was determined by weighing three balls in each sample and determining an average for each sample. Measurements of weight gain were taken after 2, 5, 9, 23 and 53 days. COR measurements were made after 5, 9, 23 and 53 days. Average values for weight gain and COR loss for each sample are shown on Table 5.

As indicated on Table 5, the golf balls having fluorinated cores had a smaller weight gain and a smaller COR loss after 23 days than the golf balls having untreated cores. After 7½ weeks, the balls of sample 5A had a (20/804)·100=2.49% COR loss. The balls of sample 5X experienced a COR loss of 3.07%. The cores of sample 5Y had a 4.06% COR loss. Thus, the inclusion of the moisture barrier reduced COR loss of covered golf balls after 7½ weeks by (3.07-2.49)·100/3.07=18.9%.

As was expected, the uncovered golf ball cores of sample 5Y had a higher weight gain and greater COR loss than the covered golf balls of sample 5X. Although the control cores of sample 5Y were from a different lot than the cores of the covered golf balls, this is not believed to have substantially affected the experimental results.

EXAMPLE 3

Golf Balls having Cores coated with Vermiculite

Nine polybutadiene golf ball cores were designated as sample 6A and were dipped in a solution of epoxy, which was used as an adhesive for the vermiculite. Nine cores of the same composition, designated as sample 6B, were dipped in the same epoxy solution as those of sample 6A and were subsequently dipped three times in a 100% inorganic dispersion of vermiculite in water sold as Microlite$^R$ 903 (W. R. Grace & Co., Cambridge, Mass.). This solution contained 7.5% solids and <28% oversized particles, and had a Ph of 7–9 and a viscosity of 200–1000 centipoise. Eleven golf ball cores of the same composition, designated as sample 6C, were dipped three times in the vermiculite solution described above, and, after drying, were dipped once in the epoxy solution described above.

Seven golf ball cores were designated as sample 6D and were dipped three times in the above-described vermiculite solution. Twelve golf ball cores were designated as sample 6X (control) and were not coated. All of the golf balls were covered with the same ionomer cover stock, had the same outer diameter, and were finished with an epoxy-polyurethane clear coat.

The initial COR of each of the golf balls samples 6A–6D as well as the golf balls designated as control sample 6X was determined.

The golf balls were placed in the high humidity oven at 100° F., 70% RH for 12 weeks. Measurements of COR loss were taken after 2 weeks, 8 weeks and 12 weeks. Results are shown in Table 6.

As shown in Table 6, the COR loss for the golf balls having a vermiculite-coated core initially was slower than the loss for the control sample. After 10 weeks, the COR of control sample 6X had decreased by 3.45%, while the COR of sample 6B, 6C and 6D had decreased by 2.90%, 3.39% and 3.14%.

It is noted that while the golf ball cores of samples 6A and 6X were from a different lot than those of samples 6B–6D, this difference is not believed to have affected the experimental results.

As shown by the above examples, a variety of different types of materials can be used as a moisture barrier to reduce the COR loss of a golf ball over time resulting from exposure to moisture.

As will be apparent to persons skilled in the art, various modifications and adaptations of the product and method above described will become readily apparent without departure from the spirit and scope of the invention, the scope of which is defined in the appended claims.

TABLE 1A

CHANGES IN WEIGHT AND COR FOR GOLF BALLS STORED IN OVEN AT 100° F. AND ABOUT 70% RELATIVE HUMIDITY

| | Original | COR CHANGE (× 1000) | | | | | Wgt change |
|---|---|---|---|---|---|---|---|
| | COR (× 1000) | 1 month | 2 mos | 4 mos | 5 mos | Original wgt (g) | after 5 mos (g) |
| Ball Type | | | | | | | |
| Supplier A | | | | | | | |
| Ball A-1 | 809 | −6 | −7 | −7 | −6 | 45.6 | 0.1 |
| Ball A-2 | 811 | −4 | −7 | −7 | −6 | 45.6 | 0.1 |
| Ball A-3 | 783 | −11 | −12 | −14 | −13 | 45.2 | 0.2 |
| Ball A-4 | 791 | −13 | −17 | −20 | −20 | 45.1 | 0.2 |
| Supplier B | | | | | | | |
| Ball B-1 | 772 | −19 | −23 | −27 | −27 | 45.1 | 0.3 |
| Ball B-2 | 773 | −17 | −22 | −27 | −27 | 45.2 | 0.3 |
| Supplier C | | | | | | | |
| Ball C-1 | 793 | −9 | −11 | −15 | −16 | 45.5 | 0 |
| Ball C-2 | 805 | −15 | −21 | −25 | −25 | 45.5 | 0.3 |
| Ball C-3 | 804 | −20 | −27 | −30 | −30 | 45.4 | 0.3 |

TABLE 1A-continued

CHANGES IN WEIGHT AND COR FOR GOLF BALLS STORED IN OVEN AT 100° F. AND ABOUT 70% RELATIVE HUMIDITY

| | Original | COR CHANGE (× 1000) | | | | | Wgt change |
|---|---|---|---|---|---|---|---|
| | COR (× 1000) | 1 month | 2 mos | 4 mos | 5 mos | Original wgt (g) | after 5 mos (g) |
| Ball C-4 | 811 | −13 | −20 | −24 | −25 | 45.4 | 0.2 |
| Ball C-5 | 812 | −17 | −26 | −31 | −31 | 45.4 | 0.3 |
| Ball C-6 | 773 | −10 | −14 | −17 | −19 | 45.4 | 0.1 |
| Ball C-7 | 816 | −8 | −11 | −9 | −8 | 45.5 | 0.2 |
| Supplier D | | | | | | | |
| Ball D-1 | 813 | −6 | −10 | −10 | −8 | 45.5 | 0 |
| Ball D-2 | 813 | −5 | −8 | −8 | −8 | 45.3 | 0.1 |
| Ball D-3 | 811 | −10 | −13 | −12 | −11 | 45.6 | 0.1 |
| Supplier E | | | | | | | |
| Ball E-1 | 805 | −11 | −14 | −11 | −10 | 45.4 | 0.1 |
| Ball E-2 | 807 | −10 | −13 | −10 | −10 | 45.3 | 0.1 |
| Ball E-3 | 796 | −5 | −10 | −12 | −7 | 45.6 | 0 |
| Ball E-4 | 795 | −4 | −9 | −10 | −5 | 45.5 | 0 |
| Ball E-5 | 807 | −13 | −15 | −15 | −14 | 45.3 | 0.1 |
| Ball E-6 | 811 | −13 | −17 | −18 | −15 | 45.3 | 0.2 |
| Ball E-7 | 790 | −5 | −14 | −16 | −9 | 45.4 | −0.1 |
| Ball E-8 | 793 | −5 | −14 | −15 | −10 | 45.5 | −0.1 |

| | | COR CHANGE (× 1000) | | | | | | |
|---|---|---|---|---|---|---|---|---|
| | Original COR (× 1000) | 1 month | 2 mos | 3 mos | 4 mos | 5 mos | Original wgt (g) | Wgt change after 5 mos (g) |
| Ball Type | | | | | | | | |
| Supplier A | | | | | | | | |
| Ball A-1 | 808 | 1 | 1 | 1 | 1 | 1 | 45.5 | 0 |
| Ball A-2 | 811 | 1 | 0 | 1 | 0 | 0 | 45.5 | 0 |
| Ball A-3 | 782 | −1 | −2 | −3 | −3 | 3 | 45.2 | 0 |
| Ball A-4 | 789 | −2 | −3 | −4 | −5 | −10 | 45.2 | 0 |
| Supplier B | | | | | | | | |
| Ball B-1 | 767 | −4 | −4 | −5 | −6 | −7 | 45.1 | 0 |
| Ball B-2 | 776 | −4 | −5 | −7 | −8 | −9 | 45.1 | 0 |
| Supplier C | | | | | | | | |
| Ball C-1 | 793 | −1 | −3 | −2 | −2 | −3 | 45.5 | −0.1 |
| Ball C-2 | 806 | −3 | −5 | −7 | −8 | −9 | 45.5 | 0 |
| Ball C-3 | 807 | −3 | −6 | −7 | −7 | −9 | 45.4 | 0 |
| Ball C-4 | 809 | −2 | −4 | −4 | −6 | −6 | 45.4 | 0 |
| Ball C-5 | 812 | −3 | −5 | −7 | −8 | −9 | 45.4 | 0 |
| Ball C-6 | 781 | 0 | −3 | −3 | −1 | −5 | 45.3 | 0 |
| Ball C-7 | 816 | 3 | 0 | 0 | −1 | 0 | 45.6 | 0 |
| Supplier D | | | | | | | | |
| Ball D-1 | 811 | −1 | 0 | −1 | −1 | 0 | 45.5 | 0 |
| Ball D-2 | 813 | 1 | −1 | −1 | −2 | −1 | 45.3 | 0 |
| Ball D-3 | 808 | 1 | 1 | 1 | 1 | 1 | 45.5 | 0 |
| Supplier E | | | | | | | | |
| Ball E-1 | 805 | 0 | 0 | −1 | −2 | 0 | 45.3 | 0 |
| Ball E-2 | 808 | 0 | 0 | 0 | −1 | −1 | 45.4 | 0 |
| Ball E-3 | 796 | 3 | 4 | 4 | 2 | 2 | 45.5 | −0.1 |
| Ball E-4 | 798 | 3 | 2 | 2 | −1 | −1 | 45.4 | 0 |
| Ball E-5 | 808 | −1 | 0 | −1 | −3 | −2 | 45.2 | 0 |
| Ball E-6 | 810 | 0 | 0 | −1 | −3 | −2 | 45.4 | 0 |
| Ball E-7 | 792 | −1 | −1 | 0 | −3 | −3 | 45.4 | −0.1 |
| Ball E-8 | 795 | −1 | −1 | −1 | −6 | −4 | 45.4 | −0.1 |

TABLE 2

COR AND WEIGHT CHANGES OF COVERED GOLF BALLS AND CORES AFTER EXPOSURE TO VARIOUS CLIMATIC CONDITIONS

| | | | COR CHANGE (+/−) (× 1000) AFTER | | | | | | | | WEIGHT CHANGE (mg) AFTER | | | | | | | |
|---|---|---|---|---|---|---|---|---|---|---|---|---|---|---|---|---|---|---|
| CLIMATIC CONDITIONS | BALL TYPE | ORIG. COR | 2 wks | 4 wks | 6 wks | 8 wks | 10 wks | 12 wks | 14 wks | 16 wks | 2 wks | 4 wks | 6 wks | 8 wks | 10 wks | 12 wks | 14 wks | 16 wks |
| ROOM TEMP | X | 808 | 0 | 0 | −3 | −2 | −2 | −3 | −6 | −8 | 3 | 5 | 7 | 10 | 11 | 12 | 20 | 28 |
| (75 F.) | Y | 812 | −2 | −2 | −4 | −3 | −3 | −6 | −6 | −9 | 3 | 5 | 7 | 9 | 11 | 13 | 18 | 26 |
| (25–35% RH) | Z | 810 | −2 | −3 | −7 | −7 | −10 | −11 | −17 | −20 | 17 | 28 | 31 | 37 | 38 | 41 | 60 | 84 |
| 125 F. OVEN | X | 810 | −3 | −2 | −5 | −2 | −2 | −3 | −4 | −9 | −11 | −16 | −19 | −19 | −21 | −22 | −19 | −18 |
| (<20% RH) | Y | 810 | 0 | 0 | −2 | 0 | −1 | −1 | −3 | −5 | −8 | −12 | −13 | −13 | −14 | −14 | −11 | −9 |
| | Z | 810 | 2 | 2 | −2 | −2 | −3 | −3 | −8 | −12 | −13 | −19 | −22 | −19 | −21 | −21 | −14 | −8 |
| HIGH | X | 811 | −10 | −15 | −22 | −24 | −27 | −28 | −31 | −33 | 60 | 89 | 127 | 155 | 176 | 193 | 212 | 234 |
| HUMIDITY | Y | 811 | −7 | −11 | −18 | −19 | −21 | −23 | −26 | −29 | 48 | 71 | 103 | 124 | 144 | 164 | 179 | 199 |
| OVEN (100 F.) | Z | 810 | −13 | −20 | −29 | −30 | −33 | −37 | −37 | −41 | 178 | 215 | 268 | 307 | 330 | 348 | 361 | 382 |
| (>70% RH) | | | | | | | | | | | | | | | | | | |
| REFRIGERA- | X | 810 | −1 | −1 | −3 | −2 | −1 | −2 | −5 | −9 | 5 | 5 | 6 | 7 | 10 | 8 | 12 | 17 |
| TOR (45 F.) | Y | 810 | −2 | 0 | −3 | −1 | −2 | −3 | −4 | −6 | 4 | 6 | 6 | 7 | 9 | 8 | 11 | 14 |
| (44% RH) | Z | 811 | −2 | −1 | −7 | −5 | −7 | −8 | −12 | −14 | 22 | 34 | 43 | 49 | 58 | 68 | 70 | 76 |
| FREEZER | X | 812 | −1 | −3 | −3 | −3 | −2 | −3 | −3 | −6 | 4 | 4 | 6 | 7 | 9 | 8 | 12 | 14 |
| @ (15 F.) | Y | 811 | 0 | 0 | −3 | −1 | −1 | 0 | −2 | −4 | 3 | 4 | 5 | 7 | 8 | 6 | 10 | 12 |
| | Z | 811 | −1 | −1 | −6 | −4 | −5 | −7 | −8 | −11 | 25 | 42 | 60 | 67 | 86 | 81 | 81 | 90 |
| FREEZER | X | 811 | −1 | −1 | −2 | −1 | 0 | 0 | −2 | −4 | 2 | 2 | 2 | 2 | 3 | 1 | 3 | 6 |
| @ (−10 F.) | Y | 810 | 0 | 0 | −1 | 0 | 1 | −1 | −2 | −4 | 1 | 1 | 1 | 1 | 1 | 1 | 1 | 4 |
| | Z | 811 | 0 | 2 | −2 | 0 | 1 | −1 | −3 | −5 | 7 | 12 | 15 | 14 | 16 | 16 | 46 | 47 |
| ROOM TEMP. | X | 811 | −6 | −8 | −14 | −15 | −18 | −20 | −24 | −28 | 47 | 79 | 118 | 136 | 166 | 176 | 209 | 227 |
| WATER | Y | 812 | −3 | −5 | −9 | −11 | −13 | −15 | −19 | −22 | 26 | 48 | 71 | 86 | 104 | 115 | 137 | 156 |
| SOAK (75 F.) | Z | 811 | −5 | −15 | −26 | −29 | −35 | −37 | −40 | −46 | 161 | 242 | 317 | 353 | 396 | 414 | 459 | 480 |
| WARM | X | 811 | −14 | −22 | −33 | −36 | −40 | −42 | −45 | −49 | 121 | 208 | 302 | 351 | 410 | 443 | 508 | 543 |
| WATER | Y | 810 | −8 | −16 | −24 | −28 | −31 | −34 | −37 | −41 | 72 | 132 | 199 | 238 | 279 | 310 | 357 | 393 |
| SOAK (100 F.) | | | | | | | | | | | | | | | | | | |

TABLE 3

WEIGHT AND COR CHANGES FOR VARIOUS TYPES OF IONOMER COVERS AFTER 42 DAYS IN A OVEN AT 100° F. AND ABOUT 70% RELATIVE HUMIDITY

| | WEIGHT GAIN (mg) | | | | | Orig. COR | COR CHANGE (× 1000) | | | | |
|---|---|---|---|---|---|---|---|---|---|---|---|
| Cover Type | Day 2 | Day 5 | Day 9 | Day 23 | Day 42 | (× 1000) | Day 2 | Day 5 | Day 9 | Day 23 | Day 42 |
| Ionomer 1 | 7 | 15.5 | 21 | 33 | 61 | 818 | +3 | −1 | −1 | −2 | −7 |
| Ionomer 2 | 2.5 | 8.5 | 13 | 22 | 42 | 820 | +2 | +1 | −2 | −2 | −6 |
| Ionomer 3 | 2 | 6.5 | 10 | 19 | 40 | 809 | 0 | 0 | −2 | −2 | −6 |
| Ionomer 4 | 1.5 | 7 | 10 | 20 | 40 | 819 | +2 | +1 | −2 | −1 | −6 |
| Ionomer 5 | 9.5 | 26.5 | 39 | 72 | 126 | 808 | 0 | −4 | −7 | −11 | −20 |
| Ionomer 6 | 12.5 | 34 | 49 | 90 | 153 | 808 | 0 | −4 | −8 | −12 | −22 |
| Ionomer 7 | 8 | 17.5 | 22 | 37 | 65 | 826 | 0 | −1 | −4 | −4 | −9 |
| Ionomer 8 | 2.5 | 8 | 12 | 23 | 49 | 811 | −2 | −4 | −4 | −6 | −9 |
| Ionomer 9 | 2 | 5.5 | 9 | 17 | 35 | 823 | +1 | +1 | 0 | −1 | −4 |
| Ionomer 10 | 12.5 | 35.5 | 51 | 92 | 161 | 807 | −1 | −7 | −9 | −12 | −24 |
| Ionomer Blend 1 | 6 | 19.5 | 29 | 51 | 107 | 810 | −1 | −4 | −5 | −10 | −17 |
| Ionomer Blend 2 | 4 | 9.5 | 14 | 25 | 48 | 825 | +2 | +1 | 0 | −2 | −6 |
| Ionomer Blend 3 | 5 | 14 | 21 | 42 | 83 | 814 | 0 | −3 | −6 | −9 | −16 |
| Ionomer Blend 4 | 3.5 | 11 | 16 | 28 | 62 | 814 | +1 | −2 | −4 | −7 | −13 |
| Methacrylic Acid | 1 | 5 | 9 | 19 | 41 | 805 | −2 | −3 | −4 | −5 | −9 |
| Acrylic Acid | 2 | 6 | 11 | 24 | 52 | 803 | −2 | −3 | −3 | −6 | −11 |
| Polyethylene | 0 | 2.5 | 4 | 10 | 24 | 798 | −3 | −5 | −6 | −10 | −16 |

TABLE 4

CHANGES IN COR FOR COVERED GOLF BALLS HAVING CORES COATED WITH POLYVINYLIDENE CHLORIDE

| Sample | Core Coating | Coating Thickness (mils) | Original COR (× 1000) | COR CHANGE (× 1000) 2 weeks | 6 weeks | 10 weeks |
|---|---|---|---|---|---|---|
| 4A | Saran Resin F-239 | 8 | 800 | −6 | −14 | −17 |
| 4B | Saran Resin F-279 | 7 | 801 | −7 | −14 | −18 |
| 4C | Saran Resin F-279 Metallized Polyester | 10 | 798 | −9 | −14 | −20 |
| 4X | None | — | 807 | −8 | −19 | −22 |

TABLE 5

CHANGES IN WEIGHT AND COR FOR FLUORINATED GOLF BALL CORES AND COVERED GOLF BALLS HAVING FLUORINATED CORES

| Sample | Original COR (× 1000) | COR CHANGE (× 1000) Day 5 | Day 9 | Day 23 | Day 53 | Original Weight (g) | WEIGHT GAIN (mg) Day 2 | Day 5 | Day 9 | Day 23 | Day 53 |
|---|---|---|---|---|---|---|---|---|---|---|---|
| 5A | 804 | −5 | −6 | −8 | −20 | 45.11 | 10 | 20 | 23 | 53 | 124 |
| 5X | 813 | −5 | −7 | −11 | −25 | 45.05 | 11 | 22 | 27 | 63 | 143 |
| 5Y | 813 | −8 | −9 | −15 | −33 | 38.12 | 46 | 77 | 92 | 160 | 259 |

TABLE 6

CHANGES IN WEIGHT AND COR FOR VERMICULITE COATED GOLF BALL CORES AND COVERED GOLF BALLS HAVING VERMICULITE-COATED CORES

| Sample | Core Coating | Original COR (× 1000) | COR CHANGE (× 1000) 2 weeks | 10 weeks | 12 weeks |
|---|---|---|---|---|---|
| 6A | Epoxy | 812 | −6 | −27 | −30 |
| 6B | Epoxy 3 coats vermiculite | 794 | −3 | −23 | −27 |
| 6C | 3 coats vermiculite Epoxy | 797 | −4 | −27 | −30 |
| 6D | 3 coats vermiculite | 797 | −4 | −25 | −30 |
| 6X | none | 811 | −7 | −28 | −29 |

What is claimed is:

1. A non-wound golf ball, comprising a central core, a cover having a thickness of at least about 30 mils and comprising a member selected from the group consisting of ionomers, acrylic acid, methacrylic acid and polyethylene surrounding the core, and a moisture barrier surrounding the core and located between the cover and the core, the moisture barrier having a lower water vapor transmission rate than the cover and an average thickness substantially less than the cover thickness, the moisture barrier having a water vapor transmission rate which is sufficiently low to reduce the loss of coefficient of restitution of the golf ball by at least 5% if the ball is stored at 100° F. and 70% relative humidity for six weeks as compared to the loss in coefficient of restitution of a golf ball which does not include the moisture barrier, has the same type of core and cover, and is stored under substantially identical conditions.

2. A golf ball according to claim 1, wherein the moisture barrier comprises a continuous layer.

3. A golf ball according to claim 2, wherein the continuous layer has an average thickness of 20 mils or less.

4. A golf ball according to claim 3, wherein the continuous layer has an average thickness of 10 mils or less.

5. A golf ball according to claim 1, wherein the moisture barrier comprises the reaction product of a barrier-forming material and the core.

6. A golf ball according to claim 5, wherein the barrier-forming material comprises fluorine.

7. A golf ball according to claim 1, wherein the moisture barrier has a water vapor transmission rate of less than about 0.2 g·mil/100 in$^2$·day at 90% RH, 100° F., ASTM D-96.

8. A golf ball according to claim 1, wherein the moisture barrier comprises vinylidene chloride.

9. A golf ball according to claim 1, wherein the moisture barrier comprises vermiculite.

10. A golf ball according to claim 1, wherein the cover comprises ionomer.

11. A golf ball according to claim 1, wherein the core is a solid core.

12. A non-wound golf ball comprising a central core, a cover comprising a member selected from the group consisting of ionomers, acrylic acid, methacrylic acid and polyethylene, and a moisture barrier surrounding the core and located between the cover and the core, the moisture barrier having a thickness of less than 20 mils and a water vapor transmission rate of less than 1.5 g·mil/100 in$^2$·day at 90% RH, 100° F., ASTM D-96.

13. A golf ball according to claim 12, wherein the moisture barrier comprises the reaction product of a barrier-forming material and the core.

14. A golf ball according to claim 13, wherein the barrier forming material comprises fluorine.

15. A golf ball according to claim 12, wherein the moisture barrier comprises vermiculite.

16. A golf ball according to claim 12, wherein the cover comprises ionomer.

17. A golf ball according to claim 12, wherein the core is a solid core.

18. A method for reducing the loss in coefficient of restitution of a two-piece, non-wound golf ball upon exposure to moisture, the golf ball having a core and a cover with a thickness of at least 30 mils which comprises a member of the group consisting of ionomers, acrylic acid, methacrylic acid and polyethylene, the method comprising the steps of providing a golf ball core and forming a moisture barrier around the core for reducing the rate of entry of water into the core, the moisture barrier being located between the cover and the core having a water vapor transmission rate of less than 1.5 g·mil/100 $in^2$·day at 90% RH, 100° F. ASTM D-96.

19. A method according to claim 18, wherein the cover comprises ionomer.

20. A method according to claim 18, wherein the core is a solid core.

* * * * *